US006832784B1

(12) United States Patent
Chen

(10) Patent No.: US 6,832,784 B1
(45) Date of Patent: Dec. 21, 2004

(54) CONTROL MECHANISM FOR RETRACTABLE TUBE ASSEMBLY

(76) Inventor: Chang-Ying Chen, No. 5, Alley 320, Shi Hu Road, Ta Li Hsiang, Taichung Hsien (TW)

( * ) Notice: Subject to any disclaimer, the term of this patent is extended or adjusted under 35 U.S.C. 154(b) by 0 days.

(21) Appl. No.: 10/854,200

(22) Filed: May 27, 2004

(51) Int. Cl.[7] ..... F16L 35/00; A47L 9/24
(52) U.S. Cl. ..... 285/7; 285/303; 285/320
(58) Field of Search ..... 285/7, 302, 303, 285/320; 15/257.7, 246.2

(56) References Cited

U.S. PATENT DOCUMENTS 3,244,437 A * 4/1966 Belicka et al. ..... 285/7
4,079,965 A * 3/1978 Moughty et al. ..... 285/7
5,332,266 A * 7/1994 Canale ..... 285/7
5,692,782 A * 12/1997 Fischer ..... 285/7
5,954,370 A * 9/1999 Pietersen ..... 285/7
6,431,607 B1 * 8/2002 Kittelmann et al. ..... 285/7
6,474,696 B1 * 11/2002 Canale ..... 285/7
6,494,492 B1 * 12/2002 Ha ..... 285/7
6,565,123 B2 * 5/2003 Schiemann et al. ..... 285/7
6,612,617 B2 * 9/2003 Xu ..... 285/7
6,634,674 B1 * 10/2003 Xu ..... 285/7
2004/0051302 A1 * 3/2004 Canale ..... 285/7

* cited by examiner

*Primary Examiner*—Eric K. Nicholson

(57) ABSTRACT

A retractable tube assembly includes an inner tube movably received in an outer sleeve and both of which extend through a sleeve. An operation member is pivotably connected to the sleeve and engaged with an opening defined through a wall of the sleeve. A protrusion extends from an inside of the operation member and a spring is biased between a cover pivotably connected to the sleeve and an outside of the operation member. The outer tube includes a recessed area defined in an outer surface thereof and a hole is defined through a wall of the outer tube and located below the recessed area. The inner has a groove defined in an outer periphery thereof and a plurality of slots are defined through an inside of the groove. The protrusion is engaged with one of the slots of the inner tube.

4 Claims, 5 Drawing Sheets

CONTROL MECHANISM FOR RETRACTABLE TUBE ASSEMBLY

FIELD OF THE INVENTION

The present invention relates to a control mechanism for controlling an inner tube movable in an outer tube.

BACKGROUND OF THE INVENTION

A conventional retractable tube assembly generally includes an outer tube and an inner tube which is movably received in the outer tube. A control mechanism is used to position the inner tube relative to the outer tube and can be different types. One of the control mechanism known to applicant is that the inner tube has a positioning piece received therein which is a V-shaped plate and a bead is connected to one of two ends of the V-shaped plate. The outer tube includes a plurality of positioning holes and the bead is engaged with one of them so as to position the inner tube relative to the outer tube. However, the V-shaped plate is difficult to be install in the inner tube and once it is shifted from its desired position, the users are difficult to retrieve it from a long inner tube. Another known arrangement is to receive a positioning piece in a dove-tailed groove defined in an outer surface of the inner tube and may engage with one of the positioning holes in the outer tube. This arrangement involves many machining so as to obtain desired complicated shapes in the inner tube and the mechanism.

The present invention intends to provide a control mechanism connected to a sleeve in which the outer tube and inner tube extend, the mechanism is reliable in operation and the inner tube can be well positioned or released by operating the control mechanism.

SUMMARY OF THE INVENTION

The present invention relates to retractable tube assembly which comprises a sleeve having a through hole through which an outer tube and an inner tube extend, and an opening defined through a wall of the sleeve. An operation member is pivotably engaged with the opening and has a protrusion extending from an inside thereof. The outer tube includes a recessed area defined in an outer surface thereof and a hole is defined through a wall of the outer tube and located below the recessed area. The inner tube has a groove defined in an outer periphery thereof and a plurality of slots are defined through an inside of the groove. The protrusion is engaged with one of the slots of the inner tube. A width of the groove is wider than a width of the recessed area. A cover is pivotably connected to the sleeve and a spring is biased between the cover and an outside of the operation member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
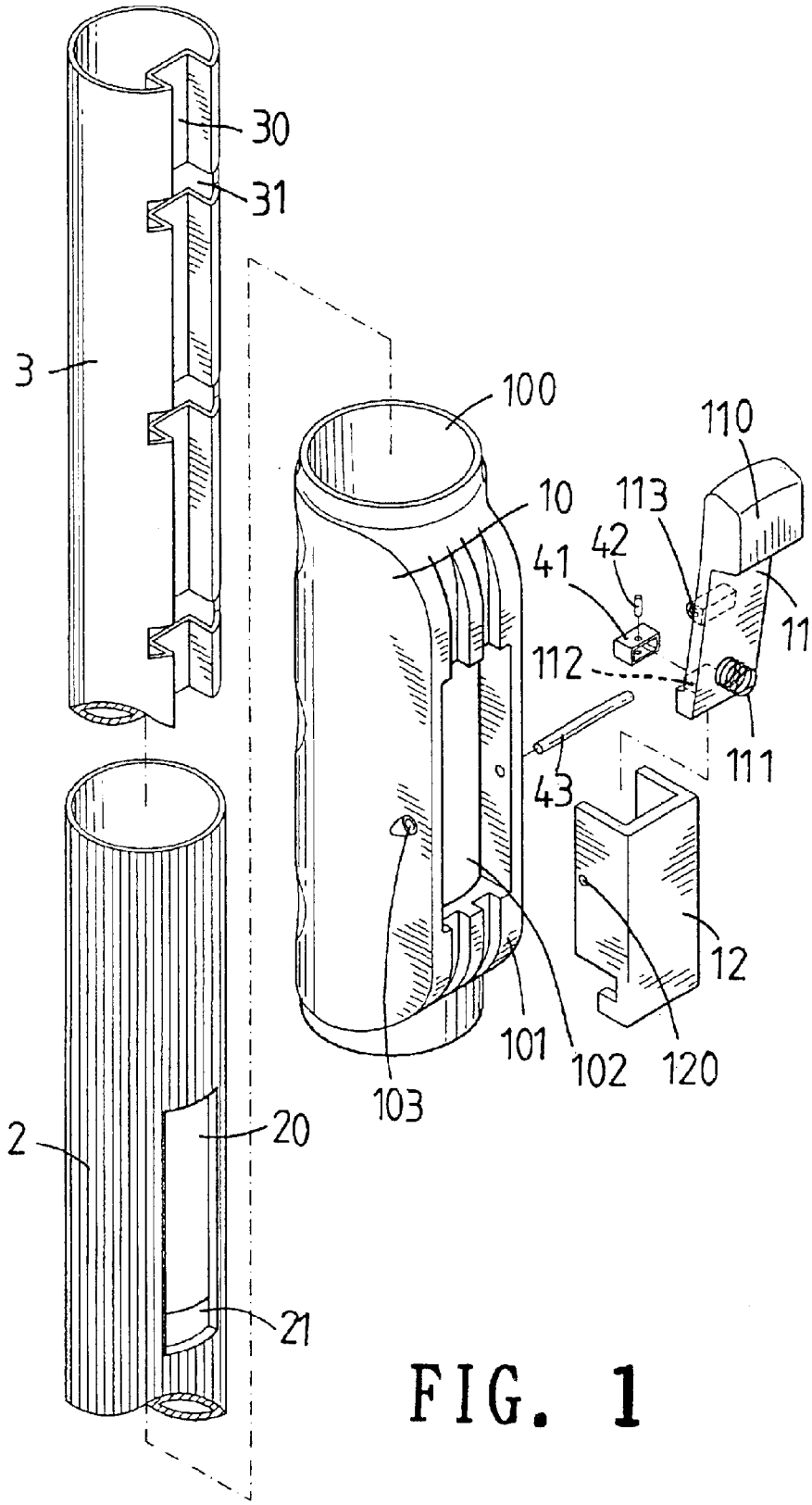
FIG. 1 is an exploded view to show the sleeve, the outer tube, the inner tube and the control mechanism of the retractable tube assembly of the present invention.
Figure 2:
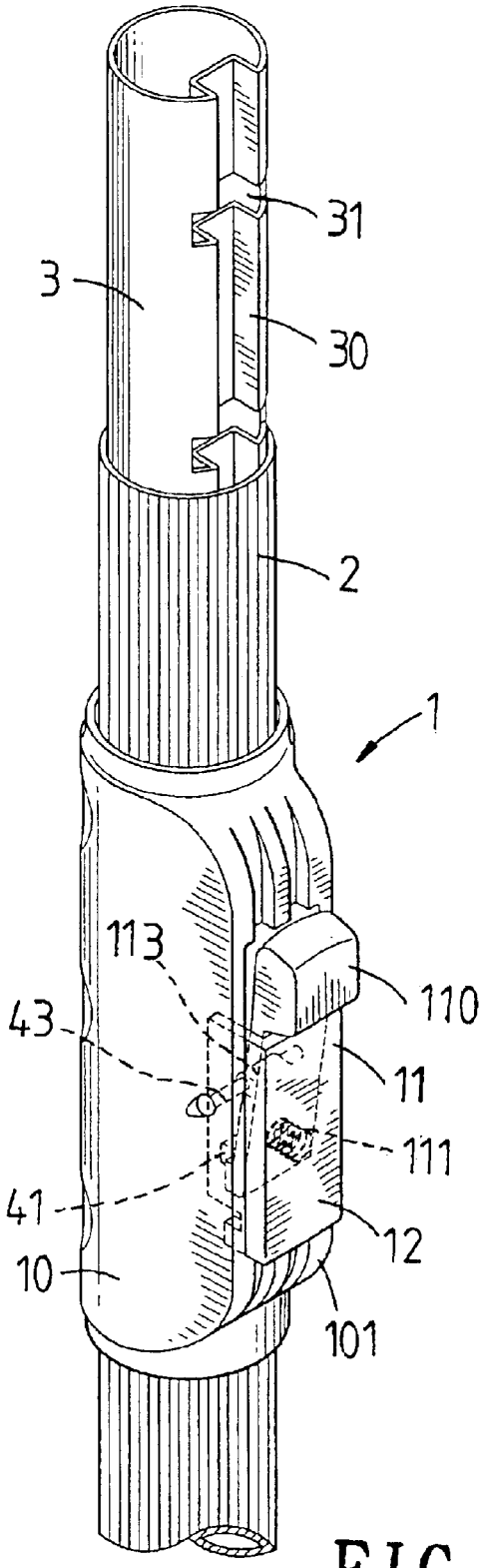
FIG. 2 is a perspective view to show the retractable tube assembly of the present invention.
Figure 4:
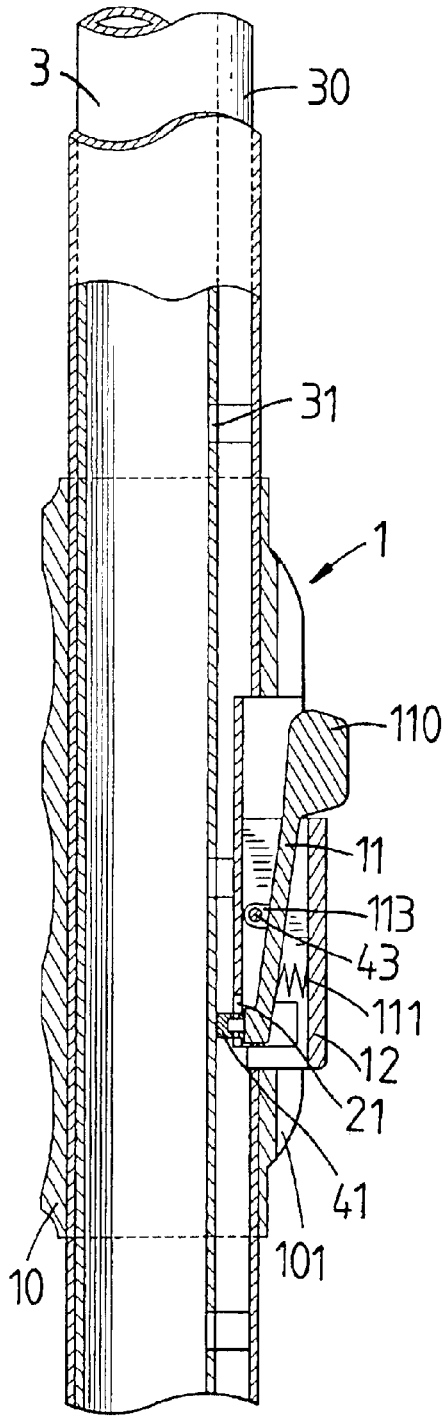
FIG. 4 shows the inner tube is moved relative to the outer tube.
Figure 3:
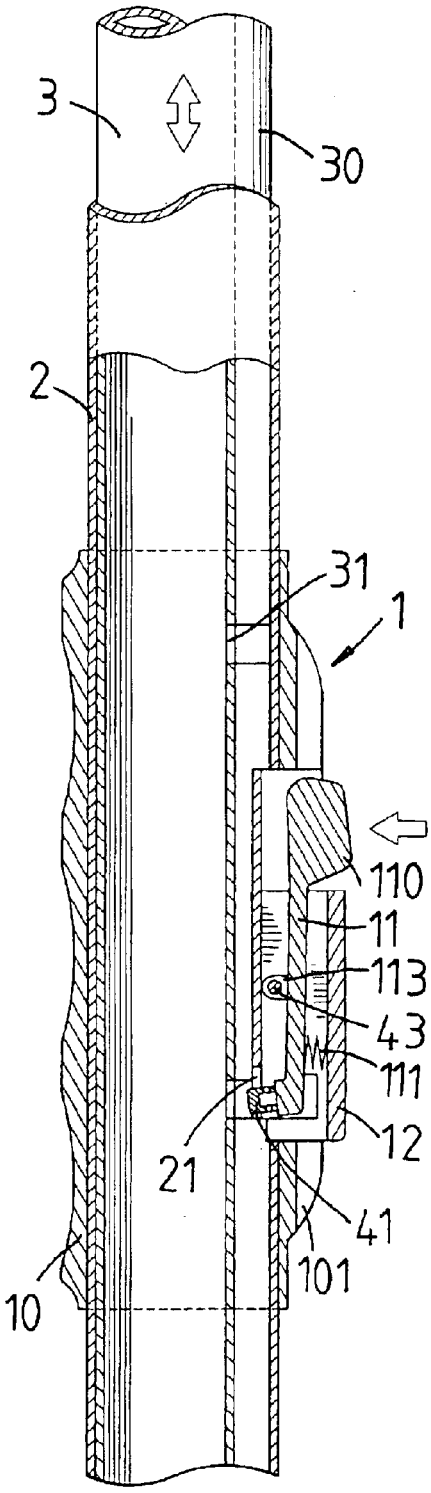
FIG. 3 is a cross sectional view to show that the operation member is pushed and the protrusion is disengaged from the slot of the inner tube so that the inner tube can be moved.
Figure 5:
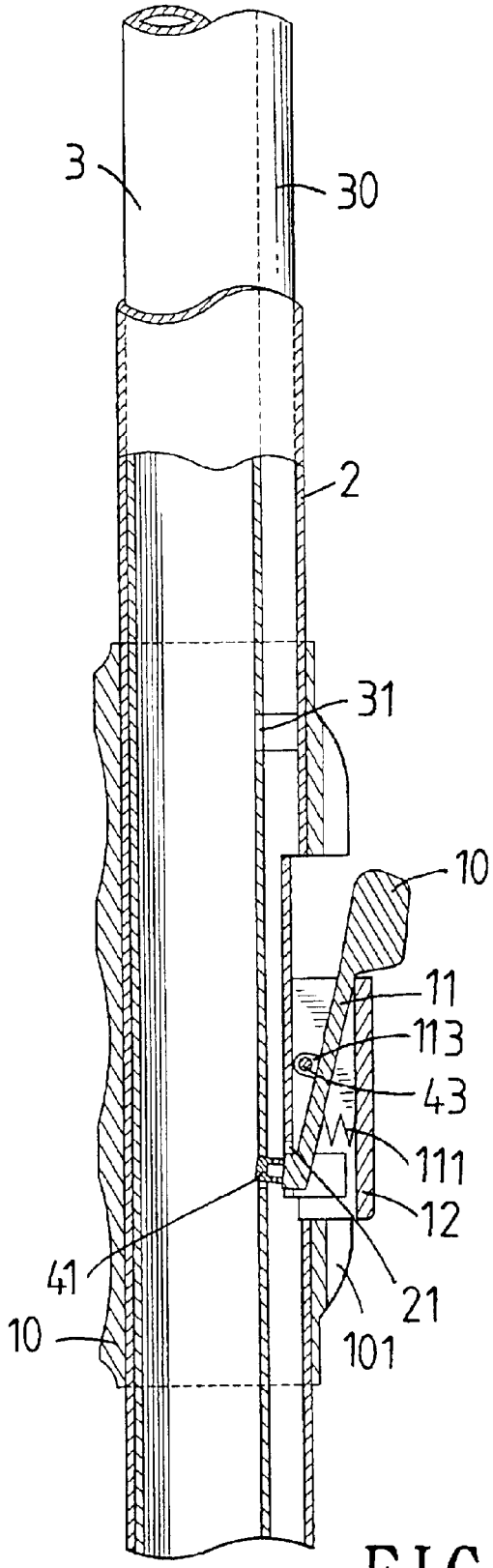
FIG. 5 shows the operation member is released and the protrusion is engaged with one of the slots of the inner tube.

Referring to FIGS. 1 and 2, the retractable tube assembly 1 of the present invention comprises a sleeve 10 having a through hole 100 defined longitudinally therethrough and an operation portion 101 which includes an opening 102 defined through a wall of the sleeve 10 so as to receive the control mechanism therein.

An outer tube 2 extends through the through hole 100 of the sleeve 10 and includes a recessed area 20 defined in an outer surface thereof. A hole 21 is defined through a wall of the outer tube 2 and located below the recessed area 20. An inner tube 3 extends through the outer tube 2 and has a groove 30 defined in an outer periphery thereof. A plurality of slots 31 are defined through an inside of the groove 30. A width of the groove 30 and the slots 31 are wider than a width of the recessed area 20.

The control mechanism includes an operation member 11 which is located between two sidewalls of a cover 12 and a pin 43 extends through two holes 103 in the sleeve 10, two holes 120 in the two sidewalls of the cover 12, and a passage 113 of a lug on an inside of the operation member 11. The operation member 11 is pivotably connected to the sleeve 10 and engaged with the opening 102. A protrusion 41 extends from the inside of the operation member 11 and is engaged with one of the slots 31 of the inner tube 3. Because the width of the groove 30 and the slots 31 are wider than the width of the recessed area 20, the protrusion 41 is sized to go through the hole 21 and engaged with one of the slots 31 for sure. A spring 111 is connected to an outside of the operation member 11 and biased between the cover 12 and the outside of the operation member 11. A push end 110 extends from the outside of the operation member 11 and is located above a top end of the cover 12 so that the user can push the push end 110 inward to move the protrusion 41 away from the slot 31. The protrusion 41 is a metal member and securely mounted to a projection 112 extending from the inside of the operation member 11 by a pin 42 extending through the protrusion 41 and the projection 112. The metal protrusion 41 can be used for a longer term.

When the protrusion 41 is disengaged from the slot 31, the inner tube 3 can be moved freely relative to the outer tube 2 till the user releases the push end 110, the spring 111 pushes the protrusion 41 to engage with another slot 31 to position the inner tube 3.

The cover 12 prevents foreign objects from entering the sleeve 10 via the opening 102 and provides a fixed wall for the spring 11.

Figure 6:
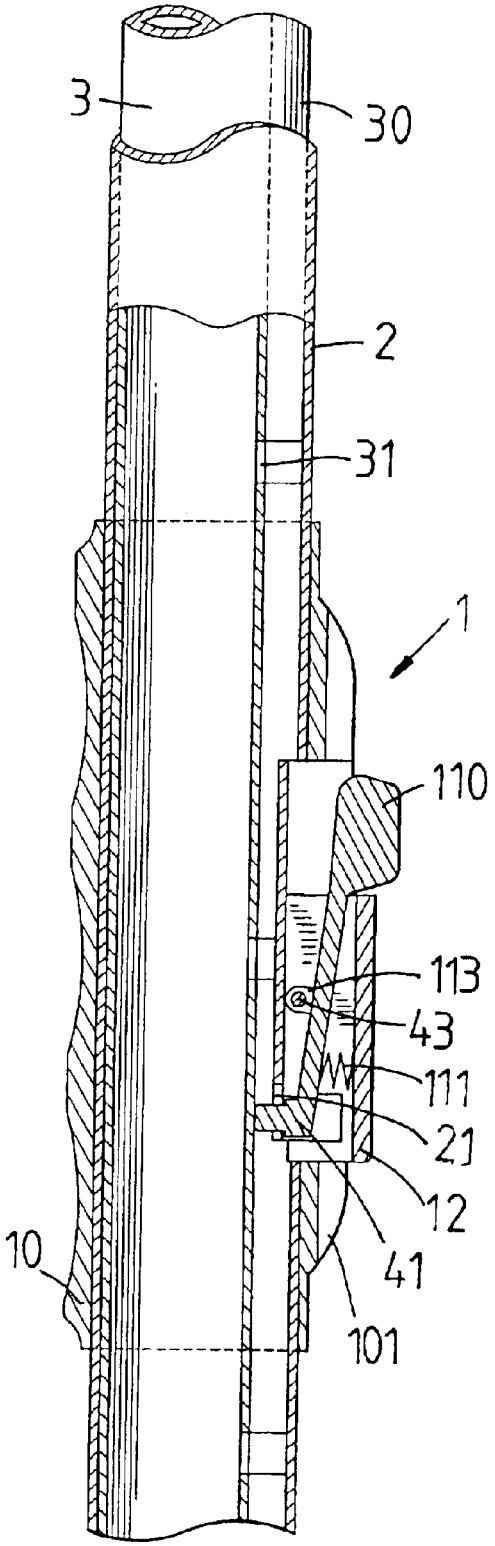
FIG. 6 is a cross sectional view to show another embodiment of the retractable tube assembly of the present invention.
Figure 7:
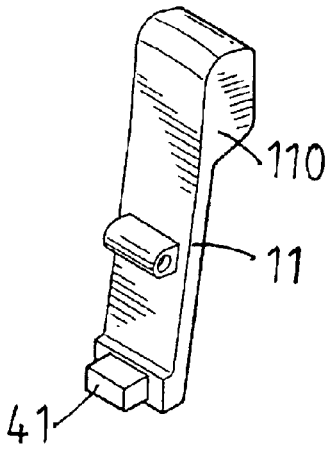
FIG. 7 is a perspective view to show the operation member used in the embodiment in FIG. 6.

FIGS. 6 and 7 show another embodiment of the present invention wherein the protrusion 41 is integrally formed with the operation member 11.

While we have shown and described the embodiment in accordance with the present invention, it should be clear to those skilled in the art that further embodiments may be made without departing from the scope of the present invention.

What is claimed is:

1. A retractable tube assembly comprising:

a sleeve having a through hole and an opening defined through a wall of the sleeve;

an operation member pivotably connected to the sleeve and engaged with the opening, a protrusion extending from an inside of the operation member;

an outer tube extending through the through hole of the sleeve and including a recessed area defined in an outer surface thereof, a hole defined through a wall of the outer tube and located below the recessed area;

an inner tube extending through the outer tube and having a groove defined in an outer periphery thereof, a plurality of slots defined through an inside of the groove, the protrusion engaged with one of the slots of the inner tube, a width of the groove being wider than a width of the recessed area, and a cover pivotably connected to the sleeve and a spring being biased between the cover and an outside of the operation member.

2. The assembly as claimed in claim 1, wherein the protrusion is a metal member and securely mounted to a projection extending from the inside of the operation member by a pin extending through the protrusion and the projection.

3. The assembly as claimed in claim 1, wherein the cover includes two sidewalls which are located in the opening and a pin extends through the sleeve, the two sidewalls of the cover and a lug extending from the inside of the operation member.

4. The assembly as claimed in claim 1, wherein a push end extends from the outside of the operation member and is located above a top end of the cover.

* * * * *